United States Patent [19]

Muhlbach et al.

[11] 4,430,766

[45] Feb. 14, 1984

[54] CEMENT SOLE ATTACHING PRESSES

[75] Inventors: Anton Muhlbach, Frankfurt am Main-Sossenheim; Helmut Stemmler, Usingen, both of Fed. Rep. of Germany

[73] Assignee: USM Corporation, Farmington, Conn.

[21] Appl. No.: 232,722

[22] Filed: Feb. 9, 1981

Related U.S. Application Data

[63] Continuation-in-part of Ser. No. 114,122, Jan. 21, 1980.

[30] Foreign Application Priority Data

Feb. 8, 1979 [DE] Fed. Rep. of Germany ..... 2904807

[51] Int. Cl.[3] ..... A43D 63/00

[52] U.S. Cl. ..... 12/16.1

[58] Field of Search ..... 12/16.1, 16.2, 16.3, 12/16.4

[56] References Cited

U.S. PATENT DOCUMENTS 3,081,468 3/1963 Barker ..... 12/16.4

4,285,085 8/1981 Bergstrasser ..... 12/16.4

FOREIGN PATENT DOCUMENTS 2047073 11/1980 United Kingdom ..... 12/16.1

*Primary Examiner*—P. D. Lawson

*Attorney, Agent, or Firm*—Donald N. Halgren

[57] ABSTRACT

A cementing press for cement attaching outsoles to lasted footwear has a counter support receiving the outsole. Two presser members are provided, one acting on a heel portion and the other acting on the toe portion of a last. A free swinging rocker assembly serves as a counter support, and includes locking means actuated before the application of full pressure, for locking the assembly in the position which the rocker assembly has assumed upon the shoe bottom being laid thereagainst.

4 Claims, 2 Drawing Figures

14
17
18
50
52
53
42
40
40
48
54
43
33
47
46
44
45
31
20
21
51
22
23
24
25b
28
30
38
27
26
29
35
34
32
37
9
15
16
2
5
7
11
12

CEMENT SOLE ATTACHING PRESSES

RELATION TO OTHER APPLICATIONS

This application is a continuation-in-part of a copending application, Ser. No. 114,122, filed Jan. 21, 1980.

BACKGROUND OF THE INVENTION (1) Field of the Invention

This invention relates to a cementing press for attaching outsoles to lasted footwear, wherein a counter-support receiving the outsole and two presser members are moved relative to one another, of which the one presser member acts on the heel portion and the other on the toe portion of the last, the counter-support consisting of pressure portions, which accommodate themselves to the shoe bottom under pressure.

(2) Prior Art

A cementing press of the basic design is described in German Patent Application No. DT-OS 26 02 831. The pressure portions on this cementing press consist of pads arranged side by side, which extend over the toe and ball region as well as over the waist section of the shoe. Each of these pads is exposed to a pressure, so that when they are under pressure they conform in their upper position to the shape of the shoe bottom. Because a relatively large number of pads are required for this cementing press, a large expenditure must be made for these components. Moreover, the basic press creates a stepped surface over the end faces of the pads when they engage the shoe bottom initially which can lead to stepped imprints, especially on shoes of high waists.

SUMMARY OF THE INVENTION

The present invention involves arranging the cementing press in such a way that it achieves a more uniform pressing effect at a reduced cost. According to the invention the toe and ball region is provided with a freely-swinging rocker-assembly that serves as a counter-support. A fulcrum extends transversely to the last within the toe and ball region and a rocker-assembly is provided with a locking means which is actuated before the application of full pressure and before the rocker-assembly has settled in a position dictated by the shoe bottom laid thereagainst.

With this arrangement only one component is used as the pressure portion in the toe and ball region, namely, the freely-swinging rocker-assembly. Moreover, a uniform pressure can be produced practically over the whole of the shoe bottom by a cushion placed in a well-known manner on the rocker-assembly, thus eliminating the pressure forming steps. Any possible pressure differentials still existing on account of the surface of the cushion and the surface of the shoe bottom not being completely identical will merge into one another continually so that the individual imprints frequently arising from the use of pads can be avoided.

To insure that the rocker-assembly can process large and small shoes without the need of an individual adaptation of the cementing press in the toe and ball region (which could lead to different angular settings of the rocker-assembly to compensate for the position of the fulcrum of the rocker-assembly), a locking means is provided, which locks the rocker-assembly in the position it has assumed before the application of the full bedding pressure. Before arrival of the full bedding pressure, the rocker-assembly, to a large extent, independent of the position of its fulcrum to the toe and ball region of the shoe to be processed) practically abuts the shoe bottom so that the rocker-assembly stays put by the locking action and that it withstands the full bedding pressure in the attained position without moving.

It is known from German Patent Application No. DE-OS 26 36 511, in connection with the basic cementing press, to use a rocker-assembly as a counter-support within the toe and ball region. This rocker-assembly, however, is adjustable by hand to a particular angular position, which is suited for each type of shoe. The patent application does not teach a freely-swinging rocker-assembly.

Appropriately, the locking means are formed as arms extending away from the rocker-assembly in the direction of the bedding pressure. Upon tipping, the rocker-assembly and the arms effect a swinging movement and engage in racks, which, when the shoe bottom is laid against the rocker-assembly, effect a movement towards the rocker-assembly and thus secure the arms. Pads may be used with this cementing press to press against the waist region of the shoe bottom. These pads press against the racks in their rest position, which are then released when the pads move the racks thus abutting the arms. The arms are then locked as in the manner described above.

The rocker-assembly is normally provided with a yieldable cushion. The cushion is disposed with its side facing the waist as a yieldable underlay substantially softer than the cushion. If the tilting of the rocker-assembly (particularly when it is used to process larger sized shoes) deviates slightly from the shoe bottom, a small gap can occur between the cushion and the toe of the shoe. The yieldable underlay, however, can be compressed a little with the initiation of the full bedding pressure, whereby the cushion is tilted slightly compared with the rocker-assembly to compensate the angular position of the rocker-assembly described above. In this way, a uniform bedding pressure is produced over the whole of the shoe bottom.

BRIEF DESCRIPTION OF THE DRAWINGS

The objects and advantages of the present invention will become more apparent when viewed in conjunction with the following two figures, which are side elevational views, partially in cross-section, of the press of the present invention. Two different shoes are shown in the Figures illustrating the versatility of the equipment.

DESCRIPTION OF THE PREFERRED EMBODIMENTS

Figure 1:
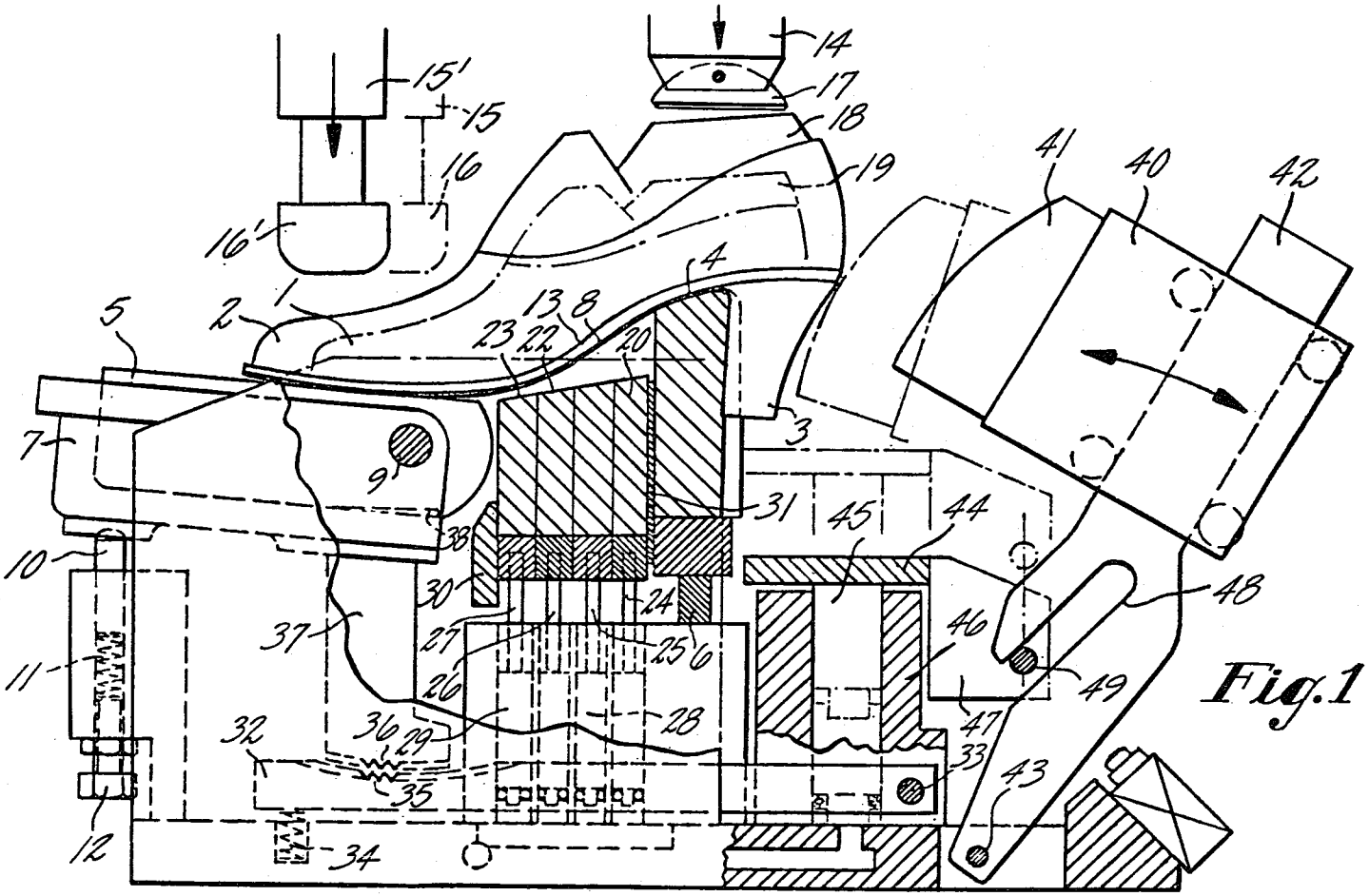
FIG. 1 is a side elevational view of the press operating on a high heeled shoe.

Referring to the drawings in detail, and particularly to FIG. 1, a shoe 2 is placed on the one end on a support 4 and on the other end on a cushion 5. The support 4 supports the shoe 2 directly ahead of its heel 3. The support 4 can be set in a known way by means of a bolt 6 to any optional, required height. In this way, the cementing press is adapted individually to the form of type of shoe to be processed. The shoe 2 lies in its toe and ball region upon the cushion 5, which is carried by a rocker-assembly 7.

The cushion 5 consists of rubber and therefore possesses the required yieldingness for the adaptation to the shoe bottom 8. The rocker-assembly 7 is pivoted by means of a fulcrum 9. At its side away from a shoe 1, shown as a smaller shoe in the FIG. 1, wherein the rocker-assembly 7 in its rest position is supported by the plunger 10, which applies pressure via spring 11 onto adjusting screw 12. By means of this adjusting screw 12 the plunger 10 can be set to any desirable height. The spring 11 allows the rocker-assembly 7 to twist downwards a little at its end away from the shoe 1 upon exertion of bedding pressure against cushion 5.

In order to expose the shoe 2 to the pressure required for attaching an outsole 13, a pair of pressure members 14 and 15 are provided. According to the length of the shoe to be processed, the presser member 15 is adjustably arranged in the longitudinal direction of shoe 2. The presser member 15 has the pad 16 at its lower end which presses onto the upper leather of the shoe 2 to be processed. The use of the pad 16 eliminates any danger that the upper leather of the shoe 2 can become damaged when pressure is exerted. The presser member 14 presses via foot 17 onto the last 18. For illustrative purposes, a respectively smaller last 19 is shown together with the shoe 1 outlined in FIG. 1.

The shoe to be processed is first placed on the support 4 and the cushion 5 as particularized above, where it takes up a position as shown in the illustration. Then the whole mechanism below the presser members 14 and 15 (or 15') is moved upwardly, so that the shoe 2 (or 1) is seated against the pad 16 (or 16') and the last 18 (or 19) contacts the foot 17 of the presser member 14. Further upward movement of the said mechanism causes the initiation of a bedding pressure that is required for attaching the outsole 13. The cementing press has a control through which a signal is given when a certain still relatively low pressure is attained. Upon receipt of the signal, the pads 20 to 23 begin an upward movement. The pads 20 to 23 are arranged directly side by side and are operated by hydraulic pistons via plungers 24 to 27 with each plunger being provided with its own hydraulic piston. For the sake of clarity of the illustration, only hydraulic pistons 28 and 29 are drawn. The pads 20 and 23 are arranged side by side and are supported at the one side by the guide 30 and at the other side by the plate 31. These construction elements are mounted to the frame of the cementing press in a conventional manner.

The pad 20 is provided with a special plunger, namely the plunger 24, which presses against the rack 32 that is pivoted at one end. The rack 32 is pivoted at its right-hand end around a fulcrum 33. In the region of its left-hand end, the rack 32 is supported by a compression spring 34. With the pad 20 in the rest position, the plunger 24 presses against the rack 32, thus fixedly holding it. However when the pads 20 to 23 are raised by the signal as described above, then plunger 24 releases rack 32, so that its left-hand end can move upwards by the force of the compression spring 34 and rotate the rack around its fulcrum 33. The rack 32 with its serrations 35 comes then into engagement with the serrations 36 of the arm 37, which is combined solidly with the rocker-assembly 7. The arm 37 responds to any swinging movement of the rocker-assembly 7 effected around its fulcrum 9.

The meshing of the serrations 35 and 36 takes place as the pads 20 to 23 are moving upwardly, that is, while the shoe bottom 8 is being exposed to only a relatively low pressure via the presser member 15 and the cushion 5. On account of this the rocker-assembly 7 has at this stage the tendency (with regard to its position above the cushion 5) to adapt itself to the shape of the shoe bottom 8. Serrations 35 and 36 then mesh so that arm 37 and the rocker-assembly 7 can no longer rotate about its fulcrum 9. Any stresses put onto the rack 32 (e.g. pull or push) are taken up by fulcrum 33. With the end faces of the pads 20 to 23 abutting outsole 13, the full pressure then builds up against the shoe 2 (or 1) without the rocker-assembly 7 being able to rotate about its fulcrum 9. Depending on the position of the pressure member 15 (or 15') relative to the fulcrum 9 of the rocker-assembly 7, a torque may be exerted on the rocker-assembly, that is, a twisting motion of the rocker-assembly 7. Cushion 5, however, cannot move because of the interlocking of the serrations 35 and 36. When full pressure builds up upon the cushion 5 and the end faces of the pads 20 to 23, the outsole 13 is then finally attached to the shoe 1 (or 2).

Drawn also into FIG. 1 in a dotted representation manner is a wedge 38 situated on the rocker-assembly 7. The wedge 38 may be inserted then on an optional basis if there is a possibility that the left-hand end of the rocker-assembly 7 is likely to yield a little under the downward pressure exerted by the presser member 15' onto a long shoe 2. When the wedge 38 is inserted for the processing of shoes of that type, then a position is created upon insertion of cushion 5, whereby it abuts the rocker-assembly 7 at its left-hand end and the wedge 38 at its right-hand end, so that a small gap is formed in the central region of the cushion 5 in relation to the rocker-assembly 7. This gap has been omitted from the drawing for reasons of clarity. Thus, the effect is established that because of the substantially greater softness of the material of the wedge, it is then compressed when full pressure is applied onto it, thus establishing in effect a position of the cushion 5 in relation to the rocker-assembly 7, as it is represented in the illustration. This means then that the cushion 5 adapts itself at a later stage to the correct position of the shoe bottom 8. Previously it was already established under the oblique setting of the cushion 5 effected by the wedge 38 in respect to the rocker-assembly 7, that the cushion 5 takes up in itself, a position in which it is brought closer toward the toe of the shoe from the center of the shoe. This is deliberate in order to give the cushion 5 the final, correct and necessary position at a later stage when the pressure is fully built up.

Figure 2:
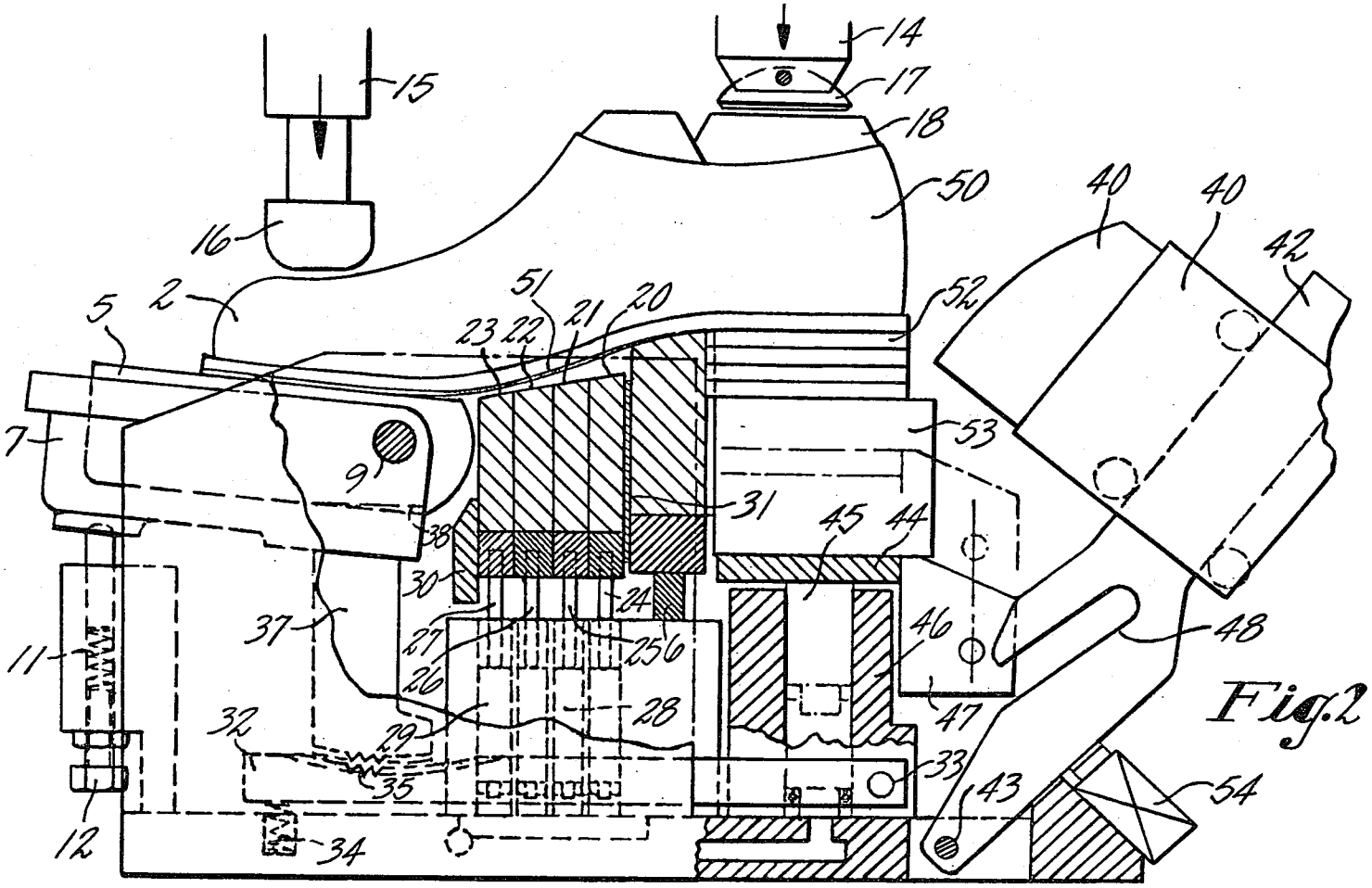
FIG. 2 is a side elevational view of the press operating on a low heeled shoe.

By using the rocker-assembly 7 (which adapts automatically to the position of the shoe bottom 8) together with the cushion 5, a very uniform spread of pressure is achieved over the toe and ball region, so that the parts of the shoe are uniformly glued together as shown similarly in FIG. 2.

Having thus described our invention, what we claim as new and desire to secure as Letters Patent of the United States is:

1. A cementing press for cement attaching outsoles to lasted footwear, wherein a counter-support receiving the outsole and two presser-members are moved relative to one another, of which the one presser-member acts on the heel portion and the other on the toe portion of the last, the counter-support having pressure portions which accommodate themselves to the shoe bottom under pressure, such that in the toe and ball region, a freely-swinging rocker-assembly is provided, serving as a counter-support, and having a fulcrum extending transversely of the last within the toe and ball region, which rocker-assembly is provided with a locking means actuated before the application of full pressure, for the position which the rocker-assembly has assumed upon the shoe bottom being laid thereagainst.

2. The cementing press according to claim 1, wherein the locking means includes arms extending away from the rocker-assembly in the direction of the bedding pressure whereby upon tipping of the rocker-assembly, a swinging movement is effected, which arms engage in racks when the shoe bottom is laid against the rocker-assembly and effect a movement toward the rocker-assembly and thus secure the arms.

3. The cementing press according to claim 1, including pads which press against the waist region, such that in their rest position, the pads press against the racks which are released when the pads move upwards against the shoe and thus abutting the arms.

4. The cementing press according to one of the claims 1 to 3, characterized thereby, that the rocker-assembly is provided with a yieldable cushion which has, on its side facing the waist, a yieldable underlay substantially softer than the cushion.

* * * * *